US008583023B2

(12) United States Patent
Yuasa

(10) Patent No.: US 8,583,023 B2
(45) Date of Patent: Nov. 12, 2013

(54) DEVELOPER CONVEYING APPARATUS, DEVELOPER STORAGE CONTAINER, AND IMAGE FORMING APPARATUS

(75) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 332 days.

(21) Appl. No.: 12/858,460

(22) Filed: Aug. 18, 2010

(65) Prior Publication Data

US 2011/0044743 A1 Feb. 24, 2011

(30) Foreign Application Priority Data

Aug. 19, 2009 (JP) ..... 2009-190246

(51) Int. Cl.
*G03G 21/12* (2006.01)

(52) U.S. Cl.
USPC ..... 399/360

(58) Field of Classification Search
USPC ..... 399/358, 360, 120
See application file for complete search history.

(56) References Cited

U.S. PATENT DOCUMENTS

| | | | | |
|---|---|---|---|---|
| 4,593,997 | A * | 6/1986 | Fox et al. | 399/360 |
| 6,363,233 | B1 * | 3/2002 | Nakajima | 399/120 |
| 2006/0120779 | A1 * | 6/2006 | Uchihashi | 399/358 |
| 2007/0196147 | A1 * | 8/2007 | Nada et al. | 399/358 |
| 2008/0253809 | A1 * | 10/2008 | Aimoto | 399/254 |
| 2010/0111582 | A1 * | 5/2010 | Nishimura et al. | 399/360 |

FOREIGN PATENT DOCUMENTS

| | | | |
|---|---|---|---|
| JP | 02-062460 | U | 5/1990 |
| JP | 04-109284 | A | 4/1992 |
| JP | 05-257410 | A | 10/1993 |
| JP | 2002-023578 | A | 1/2002 |
| JP | 2005-257813 | A | 9/2005 |
| JP | 2006162941 | A | 6/2006 |
| JP | 2007-164096 | A | 6/2007 |
| JP | 2008-083630 | A | 4/2008 |
| JP | 2008-309987 | A | 12/2008 |

* cited by examiner

*Primary Examiner* — Walter L Lindsay, Jr.
*Assistant Examiner* — Rodney Bonnette
(74) *Attorney, Agent, or Firm* — Panitch Schwarze Belisario & Nadel LLP

(57) ABSTRACT

A developer conveying apparatus includes a main body in which a developer is conveyed, a first conveying member including a first rotation shaft rotatably provided in the main body and a first conveying portion having a spiral shape and provided around the first rotation shaft, and a second conveying member including a second rotation shaft rotatably provided in the main body and a second conveying portion having a spiral shape and provided around the second rotation shaft. A developer retention portion is formed at a predetermined portion of the second conveying member.

23 Claims, 12 Drawing Sheets

DEVELOPER CONVEYING APPARATUS, DEVELOPER STORAGE CONTAINER, AND IMAGE FORMING APPARATUS

BACKGROUND OF THE INVENTION

The present invention relates to a developer conveying apparatus that conveys a developer, and relates to a developer storage container and an image forming apparatus using the developer conveying apparatus.

In a general electrophotographic image forming apparatus, a residual toner may remain on a surface of a photosensitive drum after a transferring process of a toner image. Such a residual toner is removed from the surface of the photosensitive drum using a cleaning member, and is collected by a toner collection apparatus provided in the image forming apparatus.

In this regard, it is conceivable that the toner collection apparatus can have a storage container that receives and stores a freely falling toner. However, in such a case, it is necessary to increase a size of the storage container in a vertical direction (i.e., a direction of gravity) in order to store a sufficient amount of the toner. Practically, it is difficult to provide a space for such a storage container in the image forming apparatus.

Therefore, there is proposed a toner collection apparatus having a storage container which is elongated horizontally. A toner conveying mechanism (for example, a spiral) is provided inside the storage container, which rotates to convey the toner in a horizontal direction (see, for example, Japanese Laid-open Patent Publication No. 2006-162941).

In this regard, when a large amount of the toner is stored in the storage container, the toner may be accumulated locally at a downstream part of the storage container to high density at an early stage. Such a local accumulation of the toner may increase a load on the toner conveying mechanism, and therefore the toner conveying mechanism may stop conveying even when the storage container is not filled with the toner. Therefore, it is demanded to enhance efficiency in the storage of the toner.

SUMMARY OF THE INVENTION

The present invention is intended to provide a developer conveying apparatus, a developer storage container and an image forming apparatus capable of efficiently storing a developer.

The present invention provides a developer conveying apparatus including a main body in which a developer is conveyed, a first conveying member including a first rotation shaft rotatably provided in the main body and a first conveying portion having a spiral shape and provided around the first rotation shaft, a second conveying member including a second rotation shaft rotatably provided in the main body and a second conveying portion having a spiral shape and provided around the second rotation shaft. A developer retention portion is formed at a predetermined portion of the second conveying portion.

Since the second conveying portion has the developer retention portion, timing at which the developer is accumulated at a downstream end portion of the main body (in a conveying direction of the second conveying member) is delayed. Therefore, timing at which the second conveying member is applied with a large load (due to the densely accumulated developer) is also delayed. Thus, it becomes possible to keep conveying the developer until the storage container is substantially filled with the developer. That is, the developer can be efficiently stored in the storage container.

The present invention also provides a developer conveying apparatus including a main body in which a developer is conveyed, a first conveying member including a first rotation shaft rotatably provided in the main body and a first conveying portion having a spiral shape and provided around the first rotation shaft, and a second conveying member including a second rotation shaft rotatably provided in the main body and a second conveying portion having a spiral shape and provided around the second rotation shaft. A developer retention portion is formed at a predetermined portion of the second conveying portion. Convex portions are formed on an outer circumference of the first conveying portion at predetermined intervals. The convex portions protrude in a radial direction of the first rotation shaft. The second conveying portion is configured as a portion where a part of the second conveying portion is removed.

The present invention also provides a developer storage container including the above described developer conveying apparatus.

The present invention also provides an image forming apparatus including the above described developer storage container.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The drawings are provided for purposes of explanation only and do not limit the scope of this invention.

First Embodiment

<Configuration of Image Forming Apparatus>

Figure 1:
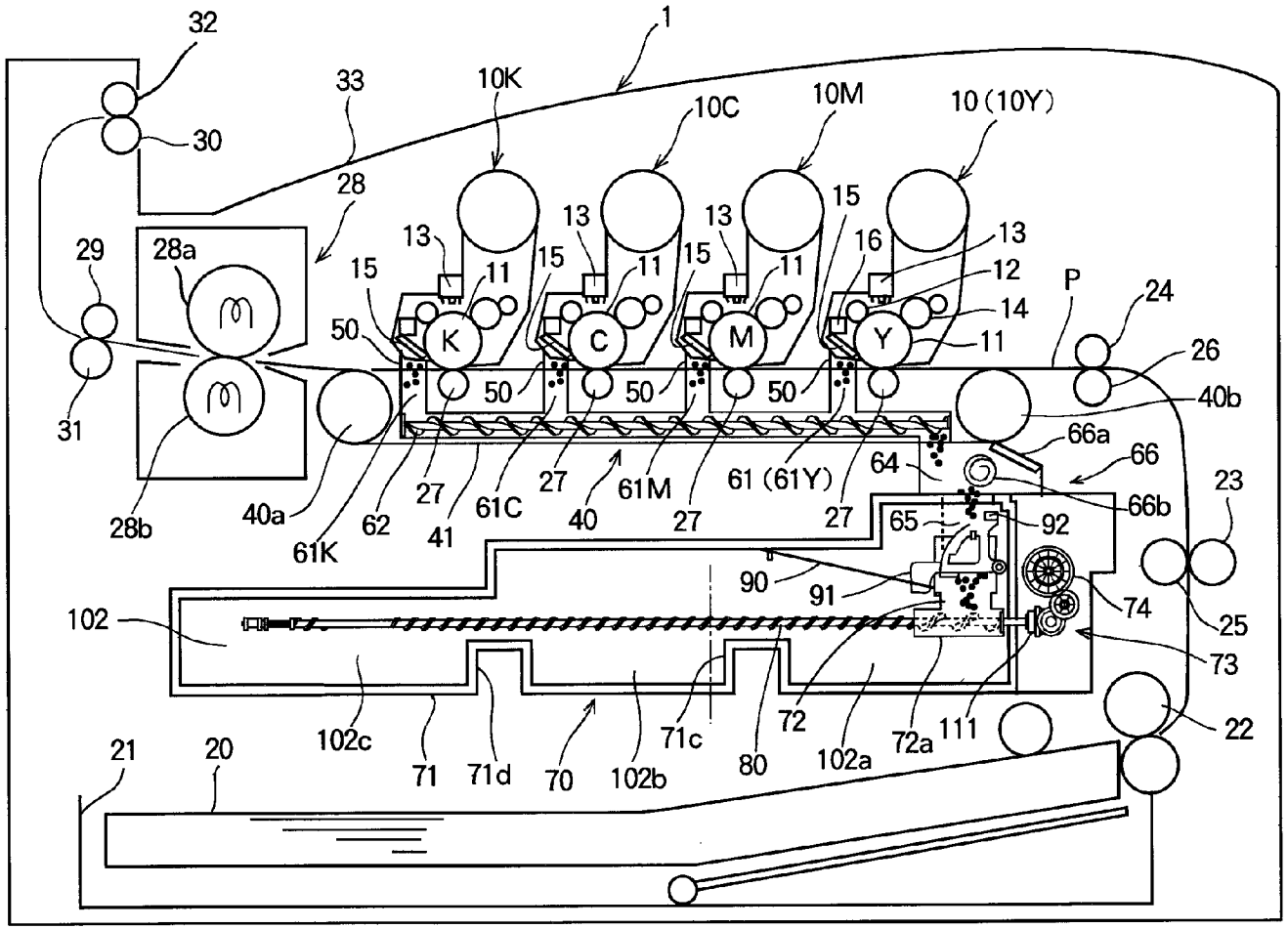
FIG. 1 is a schematic view showing a configuration of an image forming apparatus according to the first embodiment of the present invention.

FIG. 1 is a schematic view showing a configuration of an image forming apparatus according to the first embodiment of the present invention.

The image forming apparatus 1 is configured as, for example, an electrophotographic image forming apparatus having a toner collection apparatus. The image forming apparatus 1 includes four process units 10Y, 10M, 10C and 10K (also referred to as developing devices) that respectively form images of yellow (Y), magenta (M), cyan (C) and black (B). The process units 10Y, 10M, 10C and 10K are detachably mounted to a main body of the image forming apparatus 1, and are arranged from an upstream side to a downstream side along a feeding path P of a recording medium 20. The process units 10Y, 10M, 10C and 10K have common structures, and therefore collectively referred to as the process units 10.

Each process unit 10 includes a photosensitive drum 11 (as a latent image bearing body) which is rotatable in a predetermined direction, i.e., clockwise in FIG. 1. A charging roller (as a charging device) 12, an exposure device 13, a developing roller (as a developer bearing body) 14, a cleaning blade (as a cleaning member) 15 and a neutralization device 16 are provided around the photosensitive drum 11 in this order along a rotational direction of the photosensitive drum 11. The charging roller 12 uniformly electrically charges the surface of the photosensitive drum 11. The exposure device 13 irradiates the surface of the photosensitive drum 11 with light so as to form a latent image. The developing roller 14 causes a toner (i.e., a developer) to adhere to the surface of the photosensitive drum 11 where the latent image is formed, so as to develop the latent image, i.e., to form a toner image. The cleaning blade 15 removes a residual toner (hereinafter, referred to as a waste toner) that remains on the surface of the photosensitive drum 11 after the transferring of the toner image (described later). The neutralization device 16 removes a variation of a surface potential of the photosensitive drum 11. The above described rollers and the photosensitive drum 11 of each process unit 10 are rotated by a power transmitted from a not shown driving source via gears or the like.

A sheet cassette (i.e., a medium storage portion) 21 is detachably mounted to a lower part of the main body of the image forming apparatus 1. The sheet cassette 21 stores a stack of recording media 20 such as recording sheets. A feeder portion 22 is provided above the sheet cassette 21. The feeder portion 22 includes a hopping roller, a retard roller and the like for separately feeding the recording medium 20 into the feeding path P from the sheet cassette 21. A feeding roller 25 and a pinch roller 23 are provided on the downstream side of the feeder portion 22 along the feeding path P. The feeding roller 25 and the pinch roller 23 sandwich the recording medium 20 therebetween and feed the recording medium 20 along the feeding path P. A registration roller 26 and a pinch roller 24 are provided on the downstream side of the feeding roller 25 and the pinch roller 23. The registration roller 26 and the pinch roller 24 sandwich the recording medium 20 therebetween and feed the recording medium 20 to the process units 10 after correcting a skew of the recording medium 20. The feeder portion 22, the feeding roller 25 and the registration roller 26 are driven by a power transmitted from a not shown driving source via gears or the like.

Transfer rollers 27 are provided so as to face the photosensitive drums 11 of the respective process units 10. Each transfer roller 27 has a semiconductive rubber layer or the like. A voltage is applied to each transfer roller 27 by a not shown power source so as to cause a difference between the surface potential of the photosensitive drum 11 and the surface potential of the transfer roller 27, for transferring the toner image from the photosensitive drum 11 to the recording medium 20.

A belt feeding device 40 is provided below and facing the process units 10Y, 10M, 100 and 10K. The belt feeding device 40 defines a part of the feeding path P along which the recording medium 20 is fed through the process units 10Y, 10M, 100 and 10K. The belt feeding device 40 includes a transfer belt 41 passing through between the respective photosensitive drums 11 and the transfer rollers 27. The transfer belt 41 is stretched around a driving roller 40*a* and a driven roller 40*b*. The transfer belt 41 absorbs the recording medium 20 to hold the recording medium 20 thereon. The driving roller 40*a* rotates to move the transfer belt 41 so as to feed the recording medium 20 through the process units 10Y, 10M, 10C and 10K toward a fixing device 28 (described below).

The fixing device 28 is provided on the downstream side of the process unit 10K. The fixing device 28 includes a heat roller 28*a* and a backup roller 28*b*, and fixes the toner image to the recording medium 20 by applying heat and pressure. Ejection rollers 29 and 30 are provided on the downstream side of the fixing device 28, and pinch rollers 31 and 32 are provided so as to face the respective ejection rollers 29 and 30. The ejection rollers 29 and 30 and the pinch rollers 31 and 32 respectively sandwich the recording medium 20 (fed out of the fixing device 28), and eject the recording medium 20 to the outside of the image forming apparatus 1. The ejected recording medium 20 is placed on a stacker portion 33 provided outside the image forming apparatus 1.

The fixing device 28, the ejection rollers 29 and 30 and the like are driven by a power transmitted from a not shown driving source via gears.

In FIG. 1, X-axis, Y-axis and Z-axis are defined as follows. The X-axis is defined to be parallel to a direction in which the recording medium 20 proceeds through the process units 10Y, 10M, 10C and 10K. The Y-axis is defined to be parallel to an axial direction of the photosensitive drum 11 of each process unit 10. The Z-axis is defined to be perpendicular to the X-axis and the Y-axis. In other figures, the X-axis, the Y-axis and the Z-axis are used to define the same directions as those in FIG. 1.

An operation of the image forming apparatus 1 will be described.

First, the uppermost recording medium 20 of the stack stored in the sheet cassette 21 is separately fed into the feeding path P by the feeder portion 22. The recording medium 20 is further fed along the feeding path P by the feeding roller 25, the registration roller 26 and the pinch rollers 23 and 24 to reach the belt feeding device 40. Then, the recording medium 20 is fed by the belt feeding device 40 to pass the process unit 10Y. In the process unit 10Y, the latent image formed by the exposure device 13 is developed by the developing roller 14 using the yellow toner, and the yellow toner image is transferred from the photosensitive drum 11 to the surface of the recording medium 20.

Similarly, the recording medium 20 is fed through the process units 10M, 100 and 10K by the belt feeding device 40. In the process units 10M, 100 and 10K, the latent images formed by the respective exposure devices 13 are developed by the developing rollers 14 using toners of the respective colors. The toner images are transferred to the surface of the recording medium 20 by the transfer rollers 27. After the toner images of the respective colors are transferred from the photosensitive drums 11 to the recording medium 20, the recording medium 20 is further fed by the belt feeding device 40 to reach the fixing device 28, where the toner image is fixed to the recording medium 20. Then, the recording medium 20 is ejected by the ejection rollers 29 and 30 and the pinch rollers 31 and 32 to the stacker portion 33 outside of the image forming apparatus 1. With such an operation, the color image is formed on the recording medium 20.

<Configuration for Collection of Waste Toner>

Next, a description will be made of a configuration for collecting the waste toner in the image forming apparatus 1.

Toner gathering portions 50 are respectively provided below the cleaning blades 15 of the respective process units 10. The toner gathering portions 50 are provided for passing the waste toner (removed from the photosensitive drums 11 by the cleaning blades 15) to a toner conveying mechanism 60. The toner gathering portions 50 have common internal structures.

Figure 2:
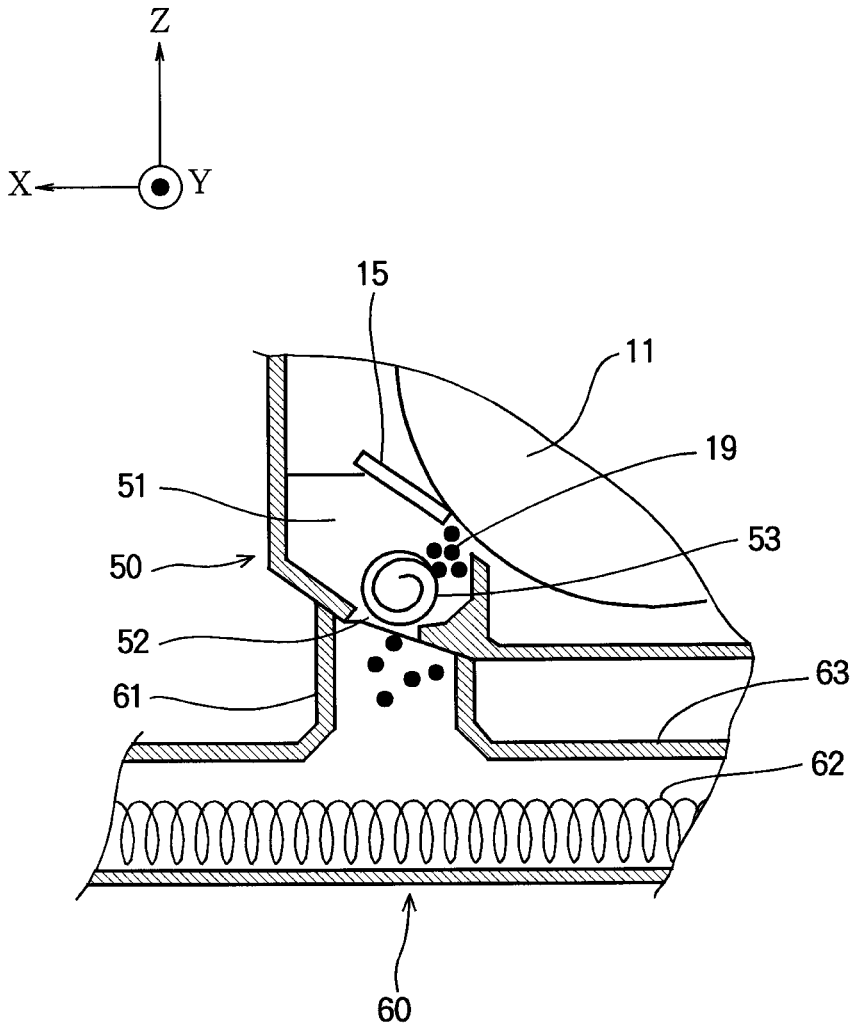
FIG. 2 is an enlarged view showing a toner collecting portion and its surrounding structure of each process unit of the image forming apparatus according to the first embodiment.

FIG. 2 is an enlarged view showing the toner gathering portion 50 and its surroundings of the process unit 10. Each toner gathering portion 50 includes a storage space 51 and a toner ejection opening 52. Further, a conveying spiral 53 is provided in the storage space 51.

In each process unit 10, the cleaning blade 15 extends along the Y-axis substantially throughout an entire length of the photosensitive drum 11. The waste toner 19 removed by the cleaning blade 15 freely falls into the storage space 51. The conveying spiral 53 has a rotation axis along the Y-axis, and is driven by a not shown driving source. The conveying spiral 53 extends substantially throughout the same region as the cleaning blade 15. The toner ejection opening 52 is formed on a bottom of the toner gathering portion 50 at an end in a positive (+) direction along the Y-axis.

In the toner gathering portion 50, the waste toner 19 removed from the photosensitive drum 11 by the cleaning blade 15 freely falls into the storage space 51, and is conveyed by the conveying spiral 53 along the Y-direction in the storage space 51. Further, the waste toner 19 conveyed by the conveying spiral 53 reaches the toner ejection opening 52, and falls downward through the toner ejection opening 52.

As shown in FIG. 1, the toner conveying mechanism 60 is provided in the image forming apparatus 1 at a positive (+) side in the direction of the Y-axis. The toner conveying mechanism 60 includes toner paths 61Y, 61M, 610 and 61K (61) spatially connected to the respective toner ejection openings 52 (FIG. 2). The toner paths 61Y, 61M, 61C and 61K receive the waste toner 19 from the respective toner ejection openings 52, and allow the waste toner 19 to freely fall therethrough. The toner conveying mechanism 60 further includes a toner conveying portion 63 extending along the X-axis and spatially connected to the toner paths 61Y, 61M, 61C and 61K. A conveying spiral 62 is provided in the toner conveying portion 63. The conveying spiral 62 has a rotation axis extending along the X-axis, and is rotated by a not shown driving source. As the conveying spiral 62 rotates, the conveying spiral 62 conveys the waste toner in a negative (−) direction along the X-axis, i.e., to the right in FIGS. 1 and 2.

As shown in FIG. 1, the toner conveying mechanism 60 further includes a toner falling portion 64, an ejection portion 65 and a transfer belt cleaning portion 66. The toner falling portion 64 is spatially connected to an end of the toner conveying portion 63 in the direction of the X-axis. The toner falling portion 64 allows the waste toner 19 (having been conveyed by the conveying spiral 62) to freely fall downward therethrough. The ejection portion 65 is spatially connected to the toner falling portion 64. The ejection portion 65 ejects the waste toner 19 to a collection container 71 (i.e., a developer storage container) of a toner collection apparatus 70 described later. The transfer belt cleaning portion 66 scrapes off the waste toner 19 remaining on the transfer belt 41 due to insufficient charge or density correction operation, and conveys the waste toner 19. The transfer belt cleaning portion 66 includes a cleaning blade 66*a* that scrapes off the waste toner 19 from the transfer belt 41 and a conveying spiral 66*b* that conveys the waste toner 19 in the positive (+) direction along the Y-axis toward the ejection portion 65.

The waste toner 19 collected at the ejection portion 65 of the toner conveying mechanism 60 is supplied to the collection container 71 of the toner collection apparatus 70 via an ejection opening described later, and is stored in the collection container 71. The toner collection apparatus 70 is detachably mounted to the image forming apparatus 1, and has a conveying spiral 80 as a developer conveying apparatus.

<Configuration of Toner Collection Apparatus>

Figure 3:
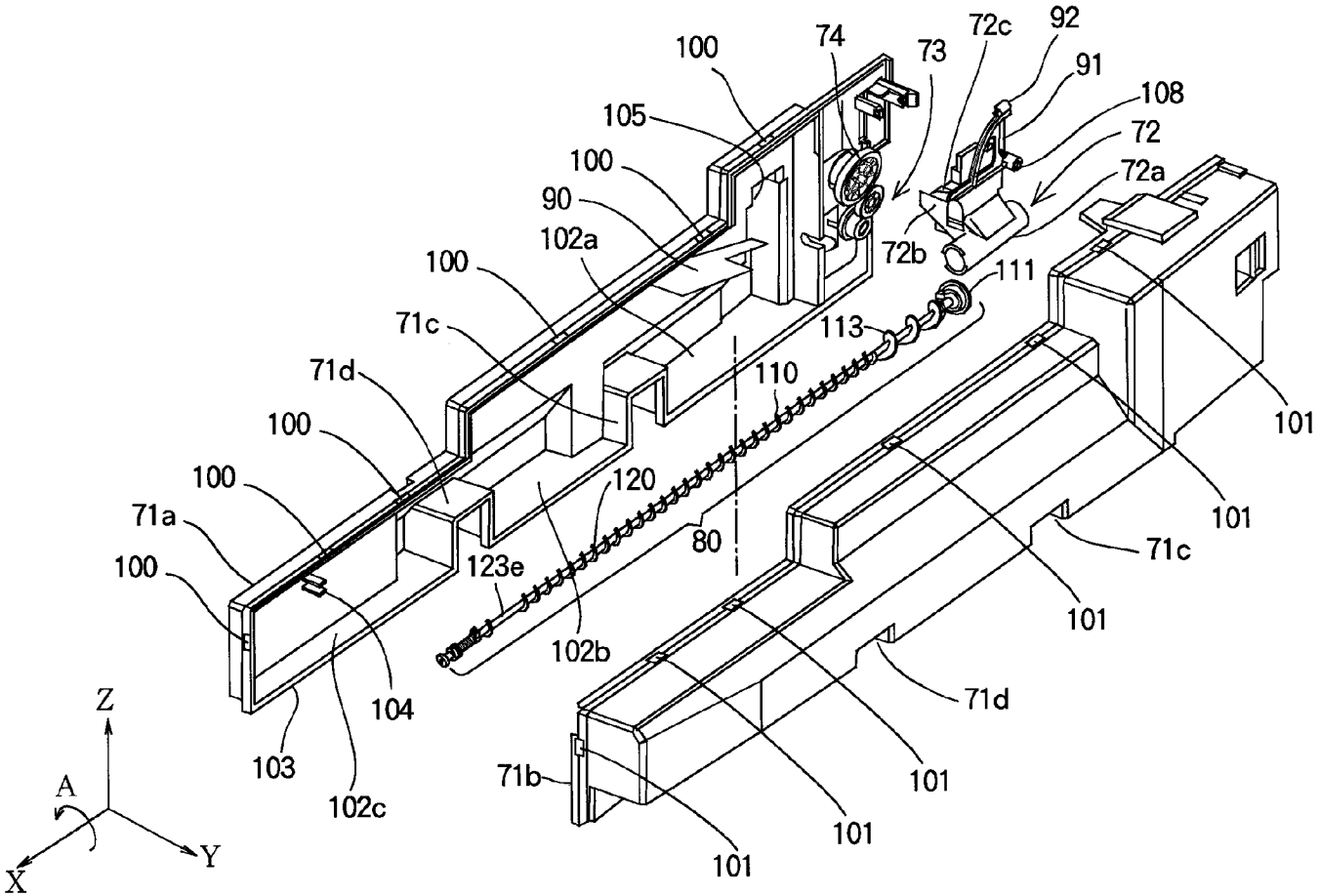
FIG. 3 is an exploded perspective view showing a toner collection apparatus of the image forming apparatus according to the first embodiment.

FIG. 3 is an exploded perspective view showing the toner collection apparatus 70 of the image forming apparatus 1 (FIG. 1) according to the first embodiment.

The toner collection apparatus 70 includes the collection container 71 (as a developer storage container), a receiving portion 72, the conveying spiral 80, a gear train 73 for driving the conveying spiral 80, and a coupling 74 for transmitting a power of a driving motor to the gear train 73.

Figure 7A:
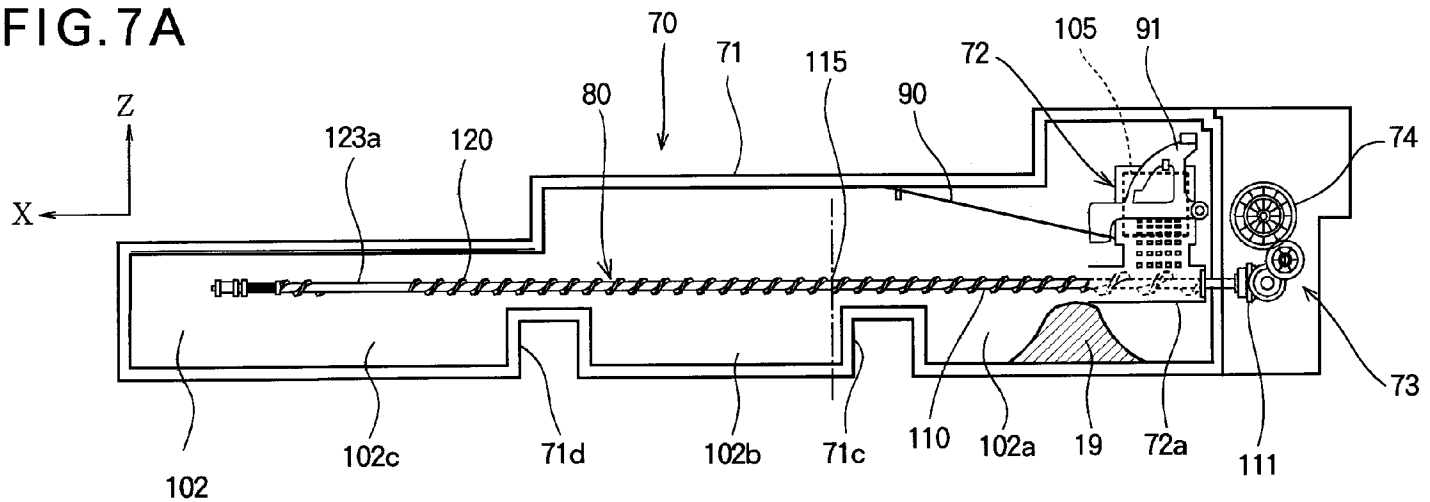
FIGS. 7A, 7B, 7C and 7D show an operation of the toner collection apparatus according to the first embodiment.

A waste toner storage amount detecting portion 90 (as a developer storage amount detecting portion) is provided in the collection container 71. The waste toner storage amount detecting portion 90 is formed of a film, i.e., a resilient body. One end of the waste toner storage amount detecting portion 90 is supported at an inner surface of the collection container 71, and the other end of the waste toner storage amount detecting portion 90 engages a waste toner storage amount detecting lever 91 (as a developer storage amount detecting lever). The waste toner storage amount detecting lever 91 (FIG. 7A) is rotatably supported by a post 108 provided an end portion thereof. As the amount of the waste toner 19 increases, the waste toner 19 pushes the waste toner storage amount detecting portion 90 upward. The waste toner storage amount detecting lever 91, which engages the end of the waste toner storage amount detecting portion 90, rotates clockwise about the Y-axis (FIG. 7A). A magnet 92 is fixed to a tip of the waste toner storage amount detecting lever 91. A magnetic flux density detection unit (not shown) is provided outside the collection container 71, which detects a rotational position of the waste toner storage amount detecting lever 91. In other words, the magnetic flux density detection unit detects that the end of the waste toner storage amount detecting portion 90 is pushed upward due to the increased amount of the waste toner 19.

As shown in FIG. 3, the collection container 71 has two covers 71*a* and 71*b* that combine each other to form a main body. Lower portions of the covers 71*a* and 71*b* fit to each other by means of fitting portions (not shown). Further, claw portions 100 provided on the upper part of the cover 71*a* engage concave portions 101 provided on the upper part of the cover 71*b*. With such fittings and engagements, the collection container 71 with a toner storage portion 102 is formed. Further, seal members 103 are fixed to joint portions of the covers 71*a* and 71*b*, for hermetically sealing the toner storage portion 102 in the collection container 71.

In the first embodiment, each of the covers 71*a* and 71*b* has a plurality of (for example, two) concave portions 71*c* and 71*d* for preventing interference between the covers 71*a* and 71*b* and members provided in the main body of the image forming apparatus 1 when the collection container 71 is mounted to the main body of the image forming apparatus 1. The concave portions 71*c* and 71*d* also function to fix the collection container 71 to the main body of the image forming apparatus 1 and to determine a position of the collection container 71 in the main body of the image forming apparatus 1. The concave portions 71*c* and 71*d* are respectively disposed on the negative (−) side and the positive (+) side along the X-axis in the collection container 71. The concaves portions 71*c* and 71*d* protrude inward into the toner storage portion 102 of the collection container 71. With such concave portions 71*c* and 71*d*, the toner storage portion 102 is divided into three spaces (i.e. toner storage compartments) 102*a*, 102*b* and 102*c* in this order from an upstream to a downstream along the X-axis. Further, not shown convex portions are formed in the main body of the image forming apparatus 1, which correspond to the concave portions 71*c* and 71*d* of the collection container 71 mounted to the main body of the image forming apparatus 1.

A pair of shaft receiving portions 104 (for the conveying spiral 80) are formed on the inner side surfaces of the covers 71*a* and 71*b* so as to face each other. The shaft receiving portions 104 rotatably support the conveying spiral 80 in the toner storage portion 102 of the collection container 71.

The receiving portion 72 of the toner collection apparatus 70 includes a cylindrical portion 72*a* extending along the X-axis, an opening-and-protruding portion 72*b* protruding perpendicularly from the cylindrical portion 72*a*, and a toner receiving opening 72*c* as an opening formed on the opening-and-protruding portion 72*b*. The toner receiving opening 72*c* leads to an inner space of the cylindrical portion 72*a*. The receiving portion 72 is mounted to recesses 105 formed on the covers 71*a* and 71*b* in such a manner that a spiral introduction part 113 (described later) of the conveying spiral 80 is disposed inside the cylindrical portion 72*a*. In this state, the opening-and-protruding portion 72*b* of the receiving portion 72 protrudes outside the storage container 701, and is connected to the ejection portion 65 of the toner conveying mechanism 60 in a state where the toner collection apparatus 70 is mounted to the main body of the image forming apparatus 1.

The conveying spiral 80 extends along the X-axis in a state where the toner collection apparatus 70 is mounted to the main body of the image forming apparatus 1. Further, an end portion of the conveying spiral 80 at the receiving portion 72 side (i.e., upstream side) protrudes outside from the toner storage portion 102 of the collection container 71. A rotation gear 111 is fixed to the protruding end portion of the conveying spiral 80. The rotation gear 111 engages the above described gear train 73.

In the description of the toner collection apparatus 70, an upstream side and a downstream side are defined along on a direction (along the X-axis) in which the conveying spiral 80 conveys the waste toner 19. That is, the upstream side corresponds to the negative (−) side along the X-axis, and the downstream side corresponds to the positive (+) side along the X-axis.

Here, a description will be made of a connection between the toner collection apparatus 70 and the toner conveying mechanism 60 in a state where the toner collection apparatus 70 is mounted to or detached from the main body of the image forming apparatus 1.

Figure 4A:
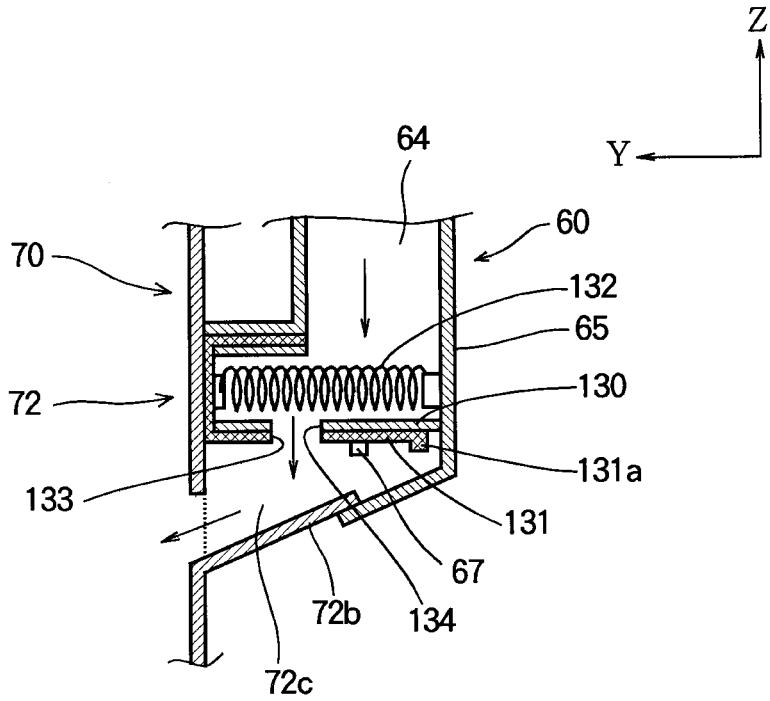
FIGS. 4A and 4B are sectional views showing a connecting portion between an ejection portion of a toner conveying apparatus and a receiving portion of the toner collection apparatus according to the first embodiment.
Figure 4B:
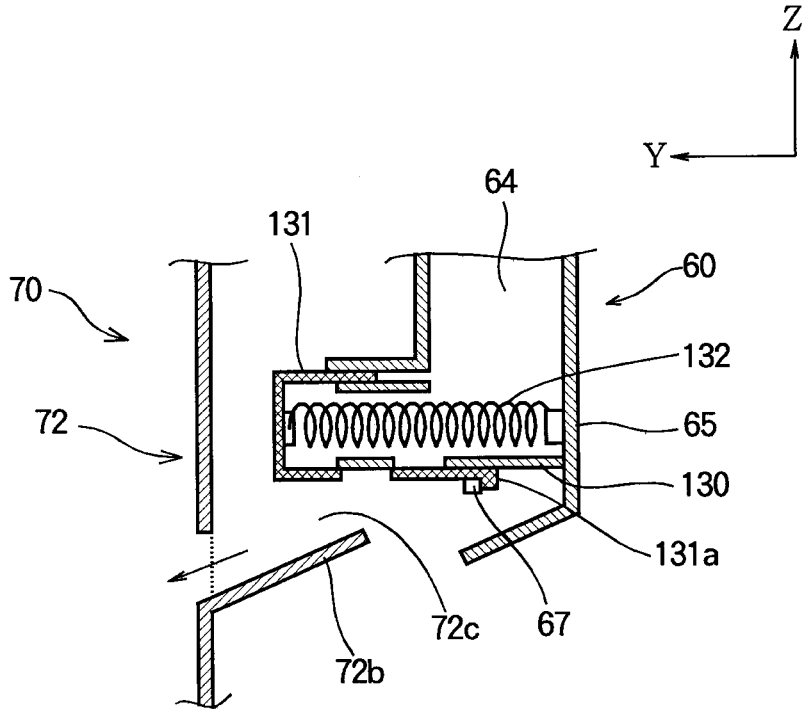

FIGS. 4A and 4B show a portion where the ejection portion 65 of the toner conveying mechanism 60 is connected to the receiving portion 72 of the toner collection apparatus 70 according to the first embodiment, as seen from the negative (−) side along the X-axis. To be more specific, FIG. 4A shows a state where the toner collection apparatus 70 is mounted to the main body of the image forming apparatus 1, and FIG. 4B shows a state where the toner collection apparatus 70 is detached from the main body of the image forming apparatus 1.

The ejection portion 65 has a fixed cap 130 spatially leading to the toner falling portion 64, and a movable cap 131 provided so as to overlap an outer surface of the fixed cap 130.

Figure 5:
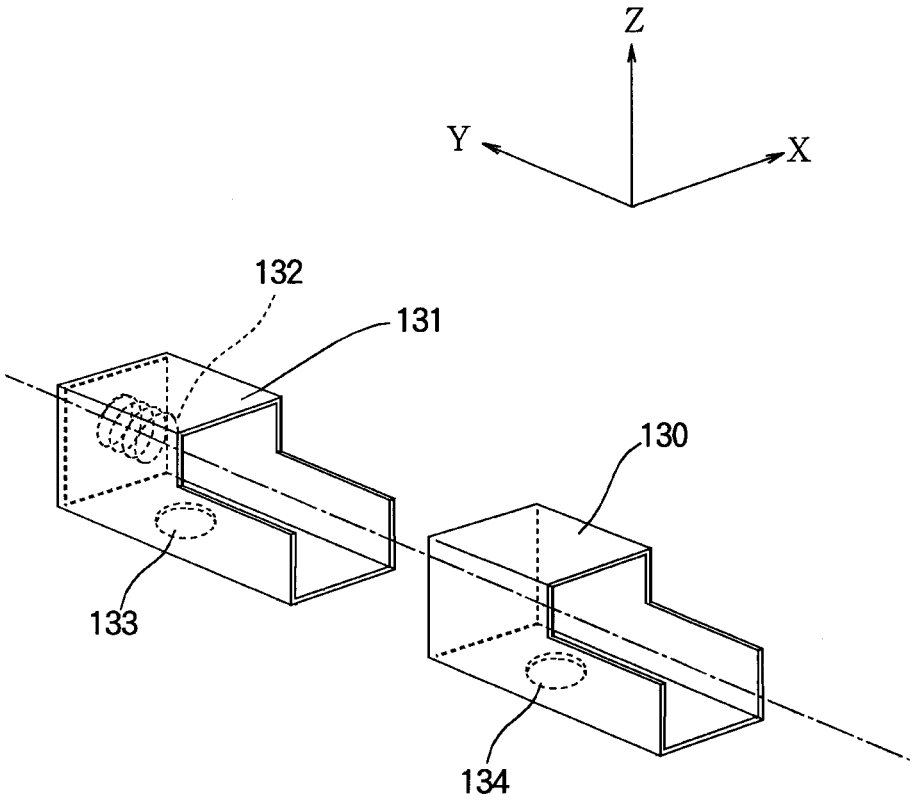
FIG. 5 is a perspective view showing a fixed cap and a movable cap of the ejection portion shown in FIGS. 4A and 4B.

FIG. 5 is a perspective view showing the shapes of the fixed cap 130 and the movable cap 131 shown in FIGS. 4A and 4B.

The movable cap 131 is supported on the outer surface of the fixed cap 130 so as to be slidable along the Y-axis. Further, the movable cap 131 is biased in the positive (+) direction along the Y-axis by means of a coil spring 132 provided between the movable cap 131 and the ejection portion 65 in a compression manner. As shown in FIG. 4A, ejection openings 133 and 134 are formed on respective bottom surfaces of the fixed cap 130 and the movable cap 131. The ejection openings 133 and 134 overlap each other in a state where the toner collection apparatus 70 is mounted to the main body of the image forming apparatus 1. The movable cap 131 has a protrusion 131*a*. As shown in FIG. 4B, the ejection portion 65 has a stopper 67 that engages the protrusion 131*a* of the movable cap 131 to limit the movement of the movable cap 131, in a state where the toner collection apparatus 70 is detached from the main body of the image forming apparatus 1.

With such a configuration, in a state where the toner collection apparatus 70 is mounted to the main body of the image forming apparatus 1, the waste toner 19 falling from the toner falling portion 64 of the toner conveying mechanism 60 passes the ejection openings 133 and 134 as shown by an arrow in FIG. 4A, further passes the toner receiving opening 72*c* of the receiving portion 72, and falls into the cylindrical portion 72*a* (FIG. 3) of the receiving portion 72 provided inside the toner storage apparatus 70.

In contrast, in a state where the toner collection apparatus 70 is detached from the main body of the image forming apparatus 1, the movable cap 131 moves in the positive (+) direction along the Y-axis (due to a biasing force of the coil sprint 132) until the movement of the movable cap 131 is prevented by the stopper 67, as shown in FIG. 4B. In this state, the ejection opening 133 of the movable cap 131 moves to a position where the ejection opening 133 does not overlap the ejection opening 134 of the fixed cap 130 as described above, and therefore the ejection portion 65 of the toner conveying mechanism 60 is closed. In this state, the waste toner 19 is accumulated in the ejection portion 65 of the toner conveying mechanism 60, and does not leak out of the toner conveying mechanism 60 in the image forming apparatus 1.

In the above description, the coil spring 132 functions to bias the movable cap 131. However, if the coil spring 132 is configured to rotate about the axis extending along the Y-axis, the coil spring 132 can also function to convey the waste toner 19 (fallen from the toner falling portion 64) to the ejection openings 133 and 134.

<Configuration of Conveying Spiral>

Figure 6A:
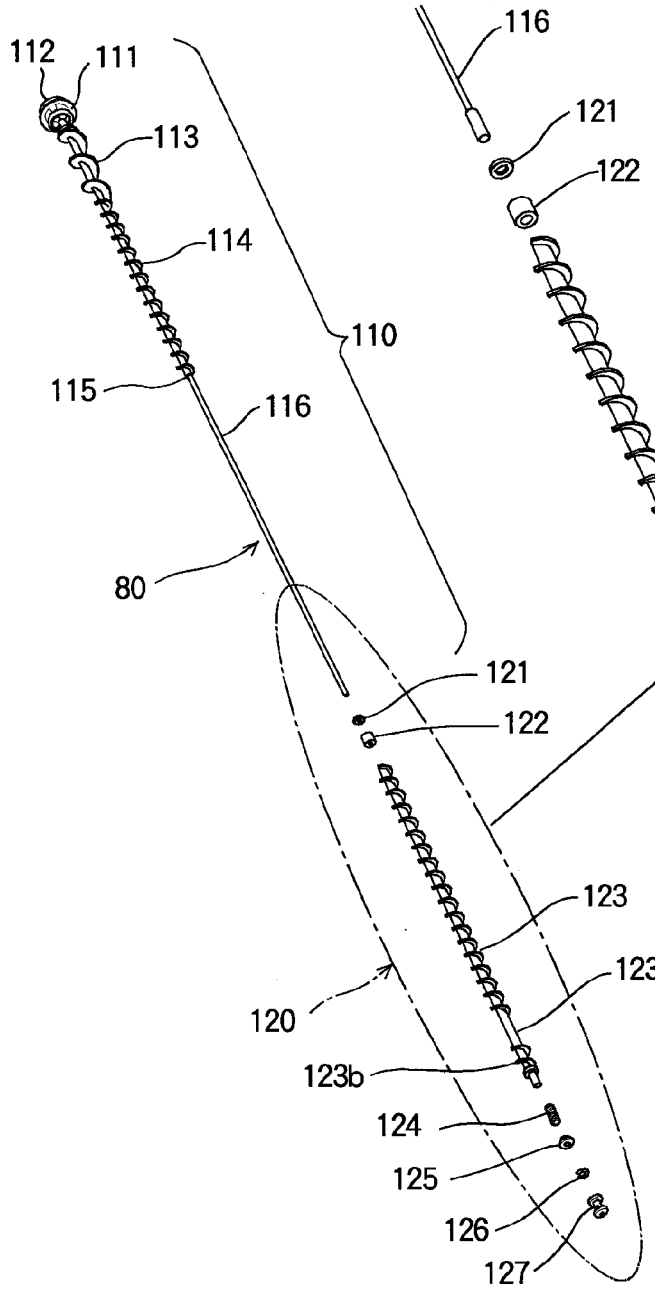
FIG. 6A is a perspective view showing a conveying spiral according to the first embodiment.
Figure 6B:
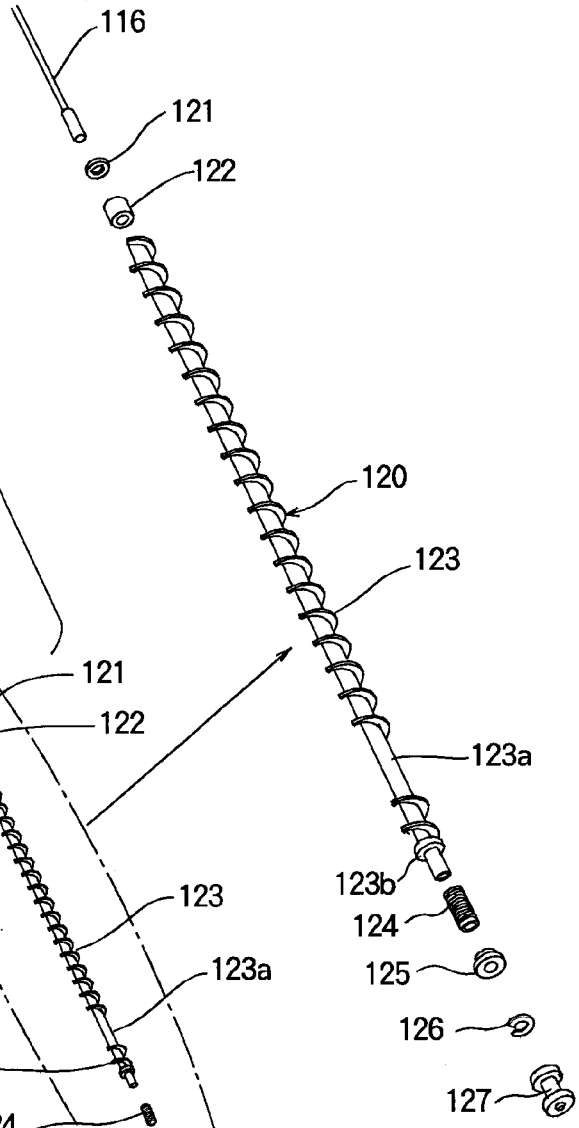
FIG. 6B is an exploded perspective view showing the conveying spiral according to the first embodiment.

FIGS. 6A and 6B show the conveying spiral 80 of the first embodiment. To be more specific, FIG. 6A is a perspective view showing a drive-side spiral 110 and a driven-side spiral 120 that constitute the conveying spiral 80. FIG. 6B is an enlarged perspective view showing the driven-side spiral 120 and its related elements.

As shown in FIG. 6A, the conveying spiral 80 includes the drive-side spiral 110 (as a first conveying member) and the driven-side spiral 120 (as a second conveying member). The drive-side spiral 110 includes the above described rotation gear 111 with and a magnet 112 fixed thereto. Further, a spiral introduction portion 113, a spiral conveying portion 114 and a connecting portion 115 are fixed to the rotation gear 111. A shaft portion 116 is connected to the connecting portion 115.

In the drive-side spiral 110, the spiral introduction portion 113 and the spiral conveying portion 114 constitute a first blade portion (i.e., a first conveying portion) having a spiral shape (with a continuous profile) formed around a shaft portion (as a first rotation shaft). The first blade portion and the connecting portion 115 are integrally formed as a plastic shaft. The shaft portion 116, which is made of metal, is fitted into an end portion of the plastic shaft so that the shaft portion 116 and the plastic shaft rotate integrally with each other. The magnet 112 is fixed to the rotation gear 111, and a rotational position of the conveying spiral 80 is detected by a magnetic flux density detection unit provided outside the collection container 71.

As shown in FIG. 6B, the driven-side spiral 120 has a tubular spiral portion 123 into which the shaft portion 116 of the drive-side spiral 110 is inserted via a nylon washer 121 and a seal sponge 122. A toner retention portion (i.e., a developer retention portion) 123*a* and a flange 123*b* are provided on an area close to an end of the spiral portion 123. A coil spring 124, a collar 125, an E-ring 126 and another collar 127 are mounted to the flange 123*b*.

The spiral portion 123 includes a tubular shaft portion (as a second rotation shaft) and a second blade portion (i.e., a second conveying portion) having a spiral shape formed around the shaft. The shaft portion and the second blade portion are integrally formed of a plastic body, and are provided coaxially with the shaft portion 116 of the drive-side spiral 110. The shaft portion 116 of the drive-side spiral 110 is inserted into a hollow portion of the spiral portion 123 (which is tubular) so that the spiral portion 123 is rotatable about the shaft portion 116. The spiral portion 123 has the toner retention portion 123*a* as a developer retention portion where no spiral is formed on the shaft portion. The toner retention portion 123*a* is located in the toner storage compartment 102*c* on the downstream side along the X-axis of the toner storage portion 102.

In this regard, it is preferable that the toner retention portion 123*a* has a length corresponding to, at least, several pitches of spiral (i.e., intervals between adjacent spirals) of the spiral portion 123.

At the connecting portion 115 connecting the drive-side spiral 110 and the driven-side spiral 120, the nylon washer 121 is disposed on the drive-side spiral 110 side, and the seal sponge 122 is disposed on the driven-side spiral 120 side. The nylon washer 121 acts as a contact portion (as a sliding member) contacting the drive-side spiral 110 and the driven-side spiral 120. The seal sponge 122 prevents the waste toner 19 from entering into between the driven-side spiral 120 and the shaft portion 116 of the drive-side spiral 110. Although the contact portion is constituted by the nylon washer 121 in this embodiment, it is also possible that an end portion of one of the drive-side spiral 110 and the driven-side spiral 120 directly contacts the other of the drive-side spiral 110 and the driven-side spiral 120. It is also possible that the drive-side spiral 110 and the driven-side spiral 120 are integrally formed as one spiral member with a thinned contact portion formed therebetween, so that the spiral member becomes separated into the drive-side spiral and the driven-side spiral when a predetermined rotational force or more is applied to the driven-side spiral.

At the downstream side of the driven-side spiral 120, the flange 123*b* is integrally formed around the spiral portion 123. The flange 123*b* contacts an end of the coil spring 124 disposed coaxially with the shaft portion 116 of the drive-shaft spiral 110. The other end of the coil spring 124 contacts the collar 125 located on the downstream side of the driven-side spiral 120. The position of the collar 125 in the axial direction is restricted by the E-ring 126 fixed to the shaft portion 116 of the drive-side spiral 110 penetrating the shaft portion 123.

The coil spring 124 is held in a state where the coil spring 124 is compressed between the flange 123*b* and the collar 125 so as to generate a predetermined biasing force of, for example, 250 gf. With such a biasing force and a friction force (i.e., a friction force between the end surface of the drive-side spiral 110 and the nylon washer 121), the driven-side spiral 120 rotates together with the drive-side spiral 110. Further, the collar 127 is provided so as to rotatably mount the shaft portion 116 to the above described shaft receiving portions 104 (FIG. 3) of the collection container 71. In a state where the collar 127 engage the shaft receiving portions 104 (FIG. 3), the driven-side spiral 120 contacts the drive-side spiral 110 via the nylon washer 121 so that the coil spring 124 is kept compressed.

<Operation of Toner Collection Apparatus>

FIGS. 7A through 7D are sectional views for illustrating an operation of the toner collection apparatus 70 according to the first embodiment.

As shown in FIG. 7A, the waste toner 19 ejected out of the toner conveying mechanism 60 falls into the cylindrical portion 72*a* of the receiving portion 72 located in the toner storage portion 102 of the toner collection apparatus 70. In this state, a rotation of the driving motor (not shown) is transmitted to the conveying spiral 80 via the gear train 73 or the like, and the conveying spiral 80 rotates in the direction A (FIG. 3) about the X-axis. Therefore, the waste toner 19 falling into the cylindrical portion 72*a* of the receiving portion 72 is conveyed downstream by the conveying spiral 80 through the cylindrical portion 72*a*, and is ejected out of the cylindrical portion 72*a* via an exit opening thereof.

As shown in FIG. 7A, if the toner storage portion 102 of the collection container 71 is almost empty, the waste toner 19 ejected out of the cylindrical portion 72*a* of the receiving portion 72 falls on a lower part of the toner storage portion 102, and is accumulated in the vicinity of the portion on which the waste toner 19 falls (i.e., in the toner storage compartment 102*a*). In this state, the driven-side spiral 120 is not applied with a force from outside, and therefore rotates together with the drive-side spiral 110.

Figure 7B:
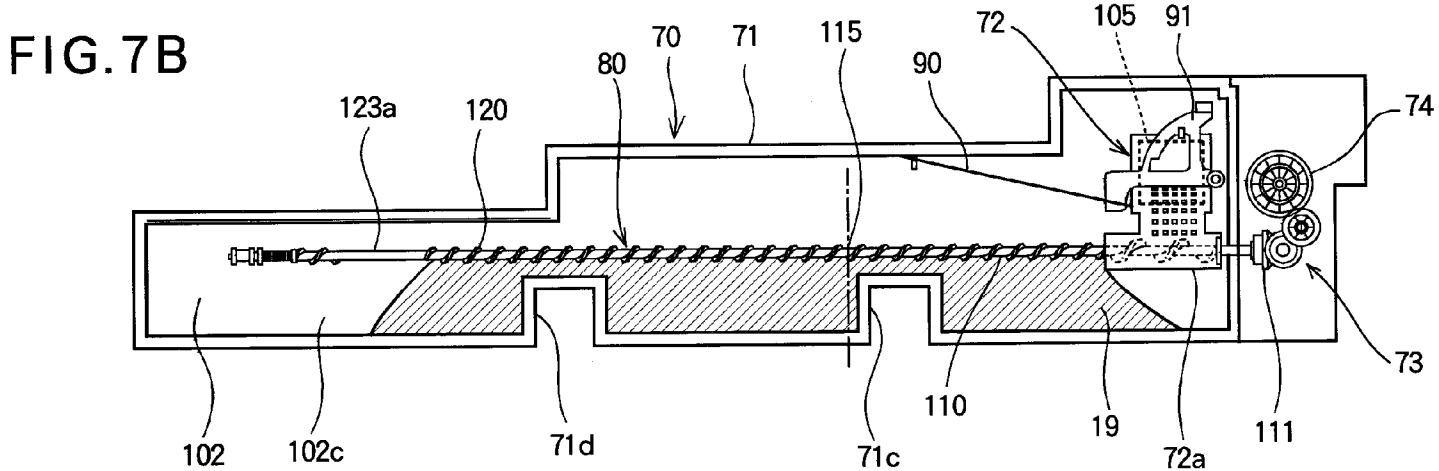

When the waste toner 19 is accumulated in the toner storage compartment 102*a* to reach a height of the conveying spiral 80, an upper part of the waste toner 19 contacts the spiral portion of the conveying spiral 80. In this case, the waste toner 19 is conveyed downstream along the X-axis by the rotation of the conveying spiral 80. As the accumulation of the waste toner 19 proceeds, the waste toner 19 reaches beyond the concave portion 71*c*, and starts to be accumulated in the toner storage compartment 102*b*, as shown in FIG. 7B. As the waste toner 19 is accumulated in the storage compartment 102*b*, the upper part of the waste toner 19 reaches the height of the conveying spiral 80. Further, the waste toner 19 reaches beyond the concave portion 71*d*, and starts to be accumulated in the toner storage compartment 102*c*. With such a process, the waste toner 19 reaches the toner retention portion 123*a* of the driven-side spiral 120 of the conveying spiral 80.

Figure 7C:
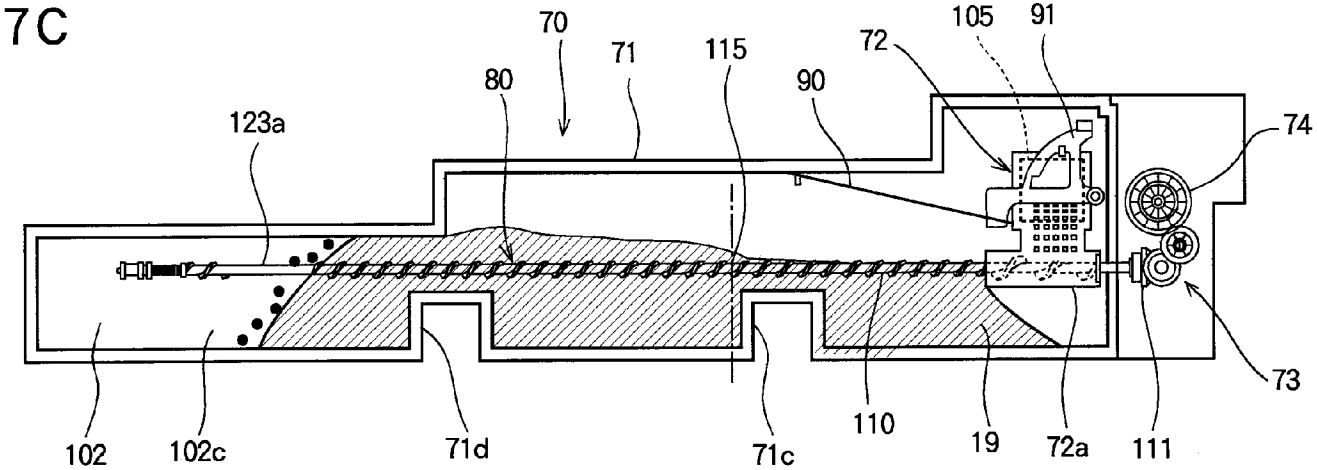

When the waste toner 19 reaches the toner retention portion 123*a*, a thrust force applied to the waste toner 19 (at the toner retention portion 123*a*) by the conveying spiral 80 disappears. In this state, as shown in FIG. 7C, the waste toner 19 starts to be accumulated upward in the toner storage portion 102. In some cases (according to the manner in which the waste toner 19 is accumulated), part of the waste toner 19 may spill downward while the waste toner 19 is accumulated upward. When the spilled waste toner 19 is accumulated and reaches beyond the toner retention portion 123*a*, the waste toner 19 starts to be conveyed by the driven-side spiral 120 again.

Later, when the waste toner 19 is accumulated above the driven-side spiral 120 and is accumulated in the downstream side of the driven-side spiral 120, the density of the waste toner 19 around the driven-side spiral 120 gradually increases. As the density of the waste toner 19 around the driven-side spiral 120 increases, a rotation load torque on the driven-side spiral 120 also increases. When the rotation load torque exceeds a predetermined value, the driven-side spiral 120 stops rotating, i.e., stops conveying of the waste toner 19.

To be more specific, when the density of the waste toner 19 around the driven-side spiral 120 in the toner storage portion 102 exceeds a predetermined value, the rotation load applied to the driven-side spiral 120 by the densely accumulated waste toner 19 exceeds the friction force between the end surface of the drive-side spiral 110 and the nylon washer 121 (due to the pushing by the coil spring 124 shown in FIG. 6B). For this reason, the rotation of the driven-side spiral 120 conveying the waste toner 19 is stopped.

Figure 7D:
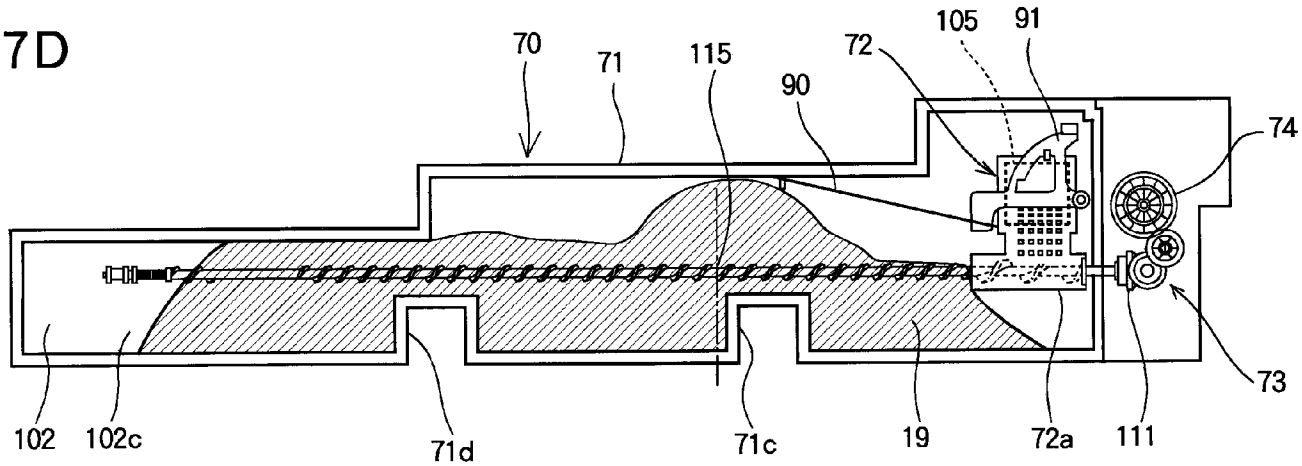

As described above, the driven-side spiral 120 stops conveying the waste toner 19 when the density of the accumulated waste toner 19 around the driven-side spiral 120 in the toner storage portion 102 exceeds the predetermined value. In this state, the conveying of the waste toner 19 is performed only by the drive-side spiral 110, and therefore the waste toner 19 is accumulated at and above the connecting portion 115 between the drive-side spiral 110 and the driven-side spiral 120 as shown in FIG. 7D. As the waste toner 19 is accumulated above the connecting portion 115, the waste toner 19 expands in the left-right direction in FIG. 7D. When the accumulated waste toner 19 pushes upward the waste toner storage amount detecting portion 90, the waste toner storage amount detecting lever 91 is rotated, and it is detected (using the magnetic flux density detection unit) that the waste toner 19 stored in the toner storage portion 102 reaches a predetermined amount.

Advantages of First Embodiment

The advantages of the first embodiment will be described.

(1) In the first embodiment, the driven-side spiral 120 of the conveying spiral 80 has the toner retention portion 123*a*, and therefore the timing at which the waste toner 19 reaches the downstream end portion of the toner storage portion 102 is delayed. Therefore, the timing at which the waste toner 19 is densely accumulated at the downstream end portion of the toner storage portion 102 (i.e., the timing at which the driven-side spiral 120 stops rotating) is also delayed. Thus, the waste toner 19 can be accumulated at more upstream part of the driven-side spiral 120, before the driven-side spiral 120 stops rotating. Therefore, a large amount of waste toner 19 can be stored in the toner storage portion 102.

Further, since the driven-side spiral 120 includes the shaft portion and the spiral portion which are integrally formed with each other, the driven-side spiral 120 can have a large conveying capacity.

Furthermore, the toner conveying spiral 80 is divided into the drive-side spiral 110 and the driven-side spiral 120, and the driven-side spiral 120 stops rotating (i.e., stops conveying the waste toner 19) when the density of the accumulated waste toner 19 around the driven-side spiral 120 exceeds the predetermined value, i.e., when the rotation load on the driven-side spiral 120 exceeds the predetermined value. Therefore, a driving unit such as a driving motor is protected from an excessive load. As a result, the conveying spiral 80 is prevented from entirely stopping the rotation due to the excessive load. In other words, it becomes possible to store a sufficient amount of the waste toner 19 in the toner storage portion 102 (particularly, in the upstream part where the density of the waste toner 19 is relatively low).

(2) If the drive-side spiral 110 and the driven-side spiral 120 are integrally formed using plastic or the like, when a large amount of the waste toner 19 is accumulated at the downstream end portion of the toner storage portion 102 (i.e., a large rotation load is applied to the conveying spiral 80), the conveying spiral 80 needs to entirely stop rotating at an early stage. In such a case, it is difficult to store a sufficient amount of the waste toner 19 in the toner storage portion 102. However, according to the first embodiment of the present invention, since the conveying spiral 80 is divided into the drive-side spiral 110 and the driven-side spiral 120, the drive-side spiral 110 keeps rotating after the driven-side spiral 120 stops rotating, and therefore a sufficient amount of the waste toner 19 can be stored in the toner storage portion 102.

Further, if the waste toner 19 has low fluidity, a load on the conveying spiral 80 becomes larger for the same amount of the waste toner 19. However, even in such a case, according to the first embodiment, only the driven-side spiral 120 stops rotating when the rotation load torque thereon exceeds the predetermined amount. That is, the conveying spiral 80 does not entirely stop rotating, and therefore a sufficient amount of the waste toner 19 can be stored in the toner storage portion 102.

Furthermore, according to the first embodiment, even if the waste toner 19 has low fluidity, it is possible to prevent the waste toner 19 (supplied via the receiving portion 72) from staying at the upstream part in the toner storage portion 102. Therefore, the waste toner 19 can be conveyed downstream in the toner storage portion 102 of the collection container 71.

(3) According to the first embodiment, the conveying spiral 80 has the spiral portion on the downstream side of the toner retention portion 123*a* in the conveying direction of the waste toner 19. The spiral portion can break the accumulated waste toner 19, and convey the waste toner 19 further downstream.

Moreover, the toner storage compartment 102*c* is capable of storing the waste toner 19 at further downstream side of the downstream end of the conveying spiral 80, and therefore the waste toner 19 can shift further downstream from the area around the driven-side spiral 120 when the waste toner 19 is accumulated around the driven-side spiral 120 to high density. Therefore, the driven-side spiral 120 does not stop rotating at an early stage. The waste toner 19 conveyed by the driven-side spiral 120 starts to be accumulated at a predetermined portion, and the accumulated waste toner 19 gradually shifts downstream. Thus, the waste toner 19 can be efficiently collected in the collection container 71, compared with a collection container in which a conveying spiral reaches a downstream end thereof (i.e., the accumulation of the waste toner is promoted at the downstream end portion of the collection container).

In this regard, although the conveying spiral 80 of the first embodiment has one toner retention portion 123*a*, it is also possible to provide a plurality of toner retention portions 123*a* corresponding to the respective toner storage compartments 102*a*, 102*b* and 102*c*, in the case where the toner storage compartments 102*a*, 102*b* and 102*c* have sufficient capacities.

Modifications of First Embodiment

The following modifications (A) to (F) can be made to the first embodiment.

(A) In the first embodiment, the driven-side spiral 120 is composed of a single component. However, the driven-side spiral 120 is not limited to such a structure. For example, it is also possible that the driven-side spiral 120 is composed of a plurality of elements (i.e., short spirals) according to the need in manufacturing or the like.

(B) In the first embodiment, one driven-side spiral 120 is provided. However, the number of the driven-side spiral 120 is not limited to one. For example, it is also possible to provide a plurality of pairs of the driven-side spirals 120 and the coil springs 124. In such a case, it is also possible that each of the driven-side spirals 120 stops rotating according to the density of the accumulated waste toner 19.

(C) In the first embodiment, each of the drive-side spiral 110 and the driven-side spiral 120 has a shaft portion and a spiral portion (on a predetermined part of the shaft portion) which are integrally formed of a plastic material. However, the drive-side spiral 110 and the driven-side spiral 120 are not limited to such a structure. For example, it is also possible to use a shaft with a coil spring, a plate spring or the like that rotates integrally with the shaft.

(D) In the first embodiment, the drive-side spiral 110 has the shaft portion 116 made of metal and fitted into the plastic shaft. However, the drive-side spiral 110 is not limited to such a structure. For example, it is also possible that the drive-side spiral 110 (including the shaft portion 116) is integrally formed of plastic material.

(E) In the first embodiment, the toner retention portion 123*a* is formed as a portion where the spiral portion is not formed on the shaft portion. However, the toner retention portion 123*a* is not limited to such a structure. For example, the toner retention portion 123*a* can have other shape as long as the toner retention portion 123*a* causes the waste toner 19 to be retained thereon.

For example, it is also possible to provide a ring-shaped washer along a circumference of the shaft portion at a predetermined position. The position of the ring-shaped washer is determined in accordance with the toner retention portion 123*a* which is located in the toner storage compartment 102*c* in the first embodiment.

Further, it is also possible that the shaft receiving portion 104 or the flange 123*b* functions as a toner retention portion. Such an arrangement can be accomplished by setting the length of the spiral portion in the toner conveying direction in accordance with a predetermined position.

Furthermore, it is also possible to form the toner retention portion 123*a* as a portion where the size (i.e., diameter) of the spiral of the driven-side spiral 120 in a direction perpendicular to the rotation shaft is reduced. In other words, the toner retention portion 123*a* can be formed as a portion where the conveying capacity is reduced. In this case, the toner retention portion 123*a* forms a second conveying section whose conveying capacity is smaller than a first conveying section of the driven-side spiral 120.

Moreover, it is also possible to form the toner retention portion 123*a* whose spiral pitch is shorter than other portion of the spiral portion 123 so as to reduce the conveying capacity at the toner retention portion 123*a*.

(F) In the first embodiment, the toner retention portion 123*a* is provided on a position corresponding to the toner storage compartment 102*c*. However, the toner retention portion 123*a* can be provided on any position in a range of the driven-side spiral 120. For example, if the waste toner 19 has high fluidity, the toner retention portion 123*a* can be provided on the upstream part of the driven-side spiral 120. With such a structure, the waste toner 19 is stored (accumulated) gradually from the upstream side to the downstream side in the toner storage portion 102.

Further, the toner retention portion 123*a* is formed as a portion where the driven-side spiral 120 has no (or small) spiral portion extending perpendicular to the rotation shaft. Therefore, in terms of effective positioning of the conveying spiral 80, it is advantageous to determine the positions of respective elements based on positional relationship between the toner retention portion 123*a*, the toner storage compartments 102*a*, 102*b* and 102*c* and the protrusions such as concave portions 71*c* and 71*d*, for example, based on closeness between the conveying spiral 80 and the protrusions (protruding inward from the covers 71*a* and 71*b* into the toner storage portion 102) or the like.

Furthermore, the waste toner 19 is accumulated at the connecting portion 115 between the drive-side spiral 110 and the driven-side spiral 120 when the driven-side spiral 120 stops rotating (see, FIG. 7D), and therefore it is advantageous to determine the position of the connecting portion 115 based on the shape of the collection container 71.

Second Embodiment

<Configuration of Toner Collection Apparatus>

Figure 8:
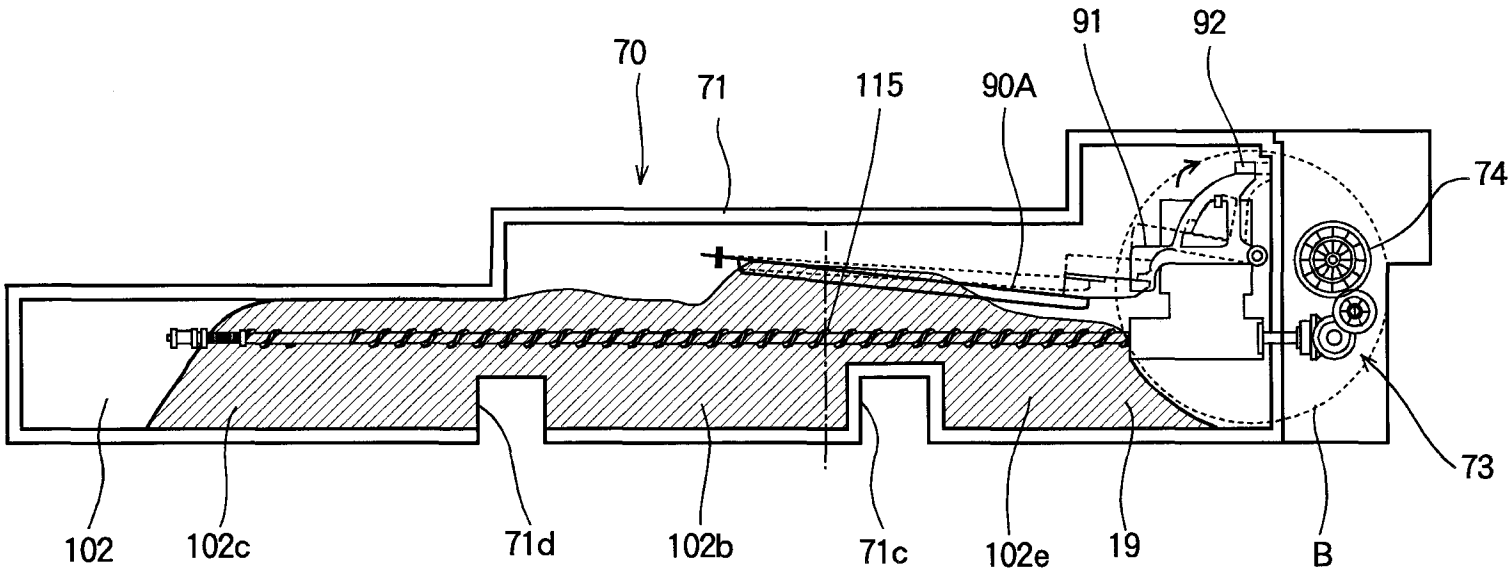
FIG. 8 shows an operation of the toner collection apparatus according to the second embodiment of the present invention.
Figure 9:
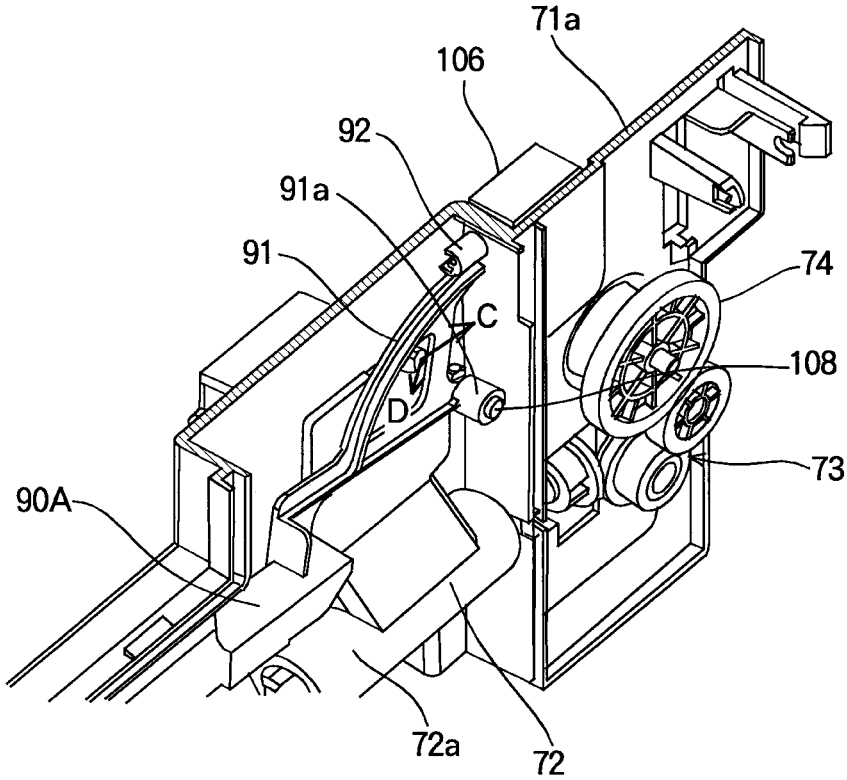
FIG. 9 is an exploded view showing a waste toner storage amount detecting portion according to the second embodiment.

FIG. 8 is a schematic view showing a toner collection apparatus 70A according to the second embodiment of the present invention. FIG. 9 is an exploded perspective view showing a waste toner storage amount detecting portion 90A of the toner collection apparatus 70A indicated by a circle B in FIG. 8. In FIGS. 8 and 9, elements which are the same as those of the first embodiment are assigned the same reference numerals.

Unlike the toner collection apparatus 70 of the first embodiment, the toner collection apparatus 70A of the second embodiment is configured so that the waste toner storage amount detecting portion 90A is located above the connecting portion 115 between the drive-side spiral 110 and the driven-side spiral 120. As with the waste toner storage amount detecting portion 90 of the first embodiment, the waste toner storage amount detecting portion 90A of the second embodiment is formed of a film as a resilient body, and engages the waste toner storage amount detecting lever 91. Further, the magnet 92 is mounted to the tip of the waste toner storage amount detecting lever 91. The waste toner storage amount detecting lever 91 is rotatably supported by the post 108 provided on the cover 71*a* of the collection container 71 via a bearing portion 91*a* of the waste toner storage amount detecting lever 91. The waste toner storage amount detecting lever 91 is rotatable in directions shown by arrows C and D in FIG. 9. A biasing force is applied to the waste toner storage amount detecting lever 91 in the direction shown by the arrow D due to gravity, which depends on positions of the bearing portion

91*a* and a gravity center of the waste toner storage amount detecting lever 91. A magnetic flux density detection unit 106 is disposed outside the collection container 71 so as to face the magnet 92 when the waste toner storage detection lever 91 is in a rotated position. As described above, the waste toner storage amount detecting portion 90A is located above the connecting portion 115 between the drive-side spiral 110 and the driven-side spiral 120 as shown in FIG. 8.

<Operation of Toner Collection Apparatus>

The operation of the toner collection apparatus 70A of the second embodiment is substantially the same as the operation of the toner collection apparatus 70 of the first embodiment. As the accumulation of the waste toner 19 proceeds in the collection container 71, the driven-side spiral 120 stops conveying the waste toner 19 as described in the first embodiment. In this state, the waste toner 19 starts to be accumulated in the toner storage compartment 102*b*, after accumulated in the toner storage compartment 102*a*. The waste toner 19 accumulated in the toner storage compartment 102*b* is conveyed by the drive-side spiral 110 downstream. However, since the driven-side spiral 120 does not rotate, the waste toner 19 is accumulated at the connecting portion 115 between the drive-side spiral 110 and the driven-side spiral 120. Therefore, the waste toner 19 starts to be accumulated above the connecting portion 115 between the drive-side spiral 110 and the driven-side spiral 120.

As the waste toner 19 is accumulated above the connecting portion 115, the waste toner storage amount detecting portion 90A located above the connecting portion 115 is pushed upward by the waste toner 19. The waste toner storage amount detecting portion 90A pushed by the waste toner 19 causes the waste toner storage amount detecting lever 91 to rotate. When the waste toner storage amount detecting lever 91 rotates to a predetermined rotational position, the magnetic flux density detection unit 106 detects the magnet 92 fixed to the tip of the waste toner storage detecting lever 91. With this, it is detected that the amount of the waste toner 19 reaches a predetermined amount.

In a state where the driven-side spiral 120 stops rotating, the connecting portion 115 defines an end portion of the conveyance of the waste toner 19 by the drive-side spiral 110, i.e., a portion where the density of the waste toner 19 is at the highest. That is, when the amount of the waste toner 19 at the connecting portion 115 increases, it indicates that waste toner 19 fills the area around the driven-side spiral 120, and is on the way of filling the area around the drive-side spiral 110. In other words, it indicates that an increased load is applied to the driving unit for driving the drive-side spiral 110. According to the second embodiment, by detecting the amount of the accumulated waste toner 19 at the connecting portion 115, it becomes possible to take measures to protect the driving unit (for rotating the conveying spiral 80) from excessive load. Therefore, it becomes possible to prevent damage to the driving unit.

Advantages of Second Embodiment

According to the toner collection apparatus 70A of the second embodiment, it becomes possible to detect that the amount of the waste toner 19 reaches the predetermined amount at an early stage. Further, preciseness of the detection can be enhanced. Therefore, when a load applied to the conveying spiral 80 is expected to be large (for example, when the waste toner 19 has low fluidity), it is possible to detect that the waste toner 19 reaches the predetermined amount before excessive load is applied to the driving unit (such as the driving motor for driving the conveying spiral 80). Thus, it becomes possible to prevent damage to the driving unit due to excessive load.

Modifications of Second Embodiment (A) In the second embodiment, the waste toner storing amount detecting portion 90A is formed of a film as a resilient body. However, the waste toner storing amount detecting portion 90A is not limited to such a material. For example, the waste toner storing amount detecting portion 90A can be a resilient body such as a plate-like rubber or a non-resilient body such as plastic or metal.

(B) In the second embodiment, the waste toner storage amount detecting lever 91 is provided inside the collection container 71. However, the waste toner storage amount detection lever 91 can also be provided outside the collection container 71. In such a case, the motion of the waste toner storage amount detecting lever 91 is directly detected using the sensor.

(C) In the second embodiment, it is also possible to estimate the amounts of the waste toner 19 accumulated in the toner storage compartments 102*a*, 102*b* and 102*c* based on the detection of the amount of the waste toner 19 at a position where the waste toner 19 is accumulated. If a larger number of the toner storage compartments are provided, it is advantageous to provide waste toner storage amount detecting portions for the respective toner storage compartments so as to detect the accumulation of the waste toner 19 therein in detail. Obviously, it is advantageous that the waste toner storage amount detecting portion 90A is provided on a portion where the waste toner 19 is most densely accumulated in the area of the drive-side spiral 110, as described in the second embodiment.

Third Embodiment

<Configuration of Toner Collection Apparatus>

Figure 10:
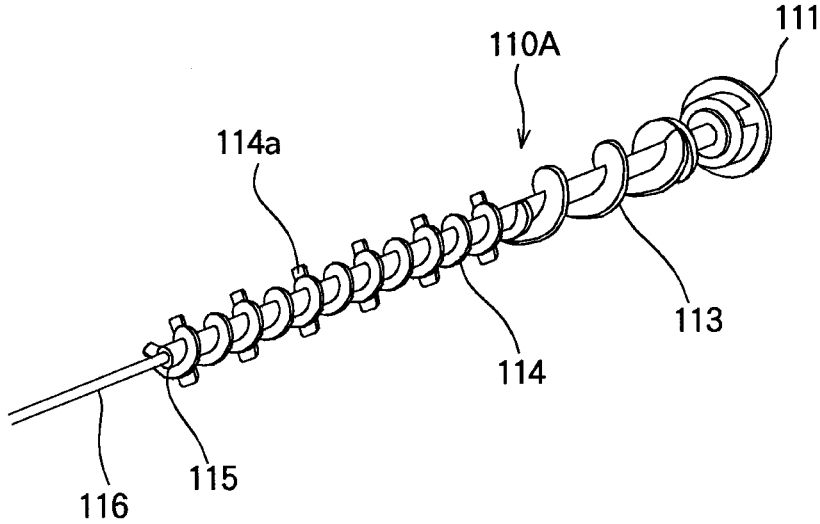
FIG. 10 is a perspective view showing a drive-side spiral according to the third embodiment of the present invention.

FIG. 10 is a perspective view showing a drive-side spiral 110A of a toner collection apparatus according to the third embodiment of the present invention. In FIG. 10, elements that are the same as those of the drive-side spiral 110 (FIG. 3A) of the first and second embodiments are assigned the same reference numerals.

Unlike the drive-side spiral 110 of the first and second embodiments, the drive-side spiral 110A of the third embodiment has projections (i.e., convex portions) 114*a* integrally formed on outer circumferences (i.e., end surfaces perpendicular to the axial direction) of the spiral conveying portion 114. The projections 114*a* are provided at constant intervals in the axial direction of the drive-side spiral 110A.

<Operation of Toner Collection Apparatus>

The toner collection apparatus of the third embodiment conveys the waste toner 19, as with the toner collection apparatus 70 (70A) described in the first and second embodiment.

In this regard, when the waste toner 19 has low fluidity, the waste toner 19 supplied to the toner storage portion 102 via the cylindrical portion 72*a* of the receiving portion 72 (FIG. 1) may form a tunnel-shaped agglomerate around the spiral conveying portion 114 of the drive-side spiral 110. In such a case, the projections 114*a* of the spiral conveying portion 114 can break the agglomerate, so that the conveyance of the waste toner 19 to the downstream side can be smoothly performed.

Advantages of Third Embodiment

According to the third embodiment, even when the waste toner 19 has low fluidity, the drive-side spiral 110A is able to break the agglomerate of the waste toner 19 using the projections 114*a* at the upstream part of the toner storage portion 102. Therefore, the conveying ability of the waste toner 19 toward the downstream side of the toner storage portion 102 does not decrease.

Modifications of Third Embodiment (A) In the third embodiment, the projections 114*a* are provided at constant intervals. However, the projections 114*a* are not limited to such an arrangement. For example, it is also possible that the projections 114 are provided at irregular intervals.

(B) In the third embodiment, the projections 114*a* are formed integrally with the spiral conveying portion 114. However, the projections 114*a* are not limited to such a structure. For example, it is also possible that the protrusions 114*a* are not formed integrally with the spiral conveying portion 114, but are fixed to the outer circumferences of the spiral conveying portion 114.

Fourth Embodiment

<Configuration of Toner Conveying Apparatus>

Figure 11:
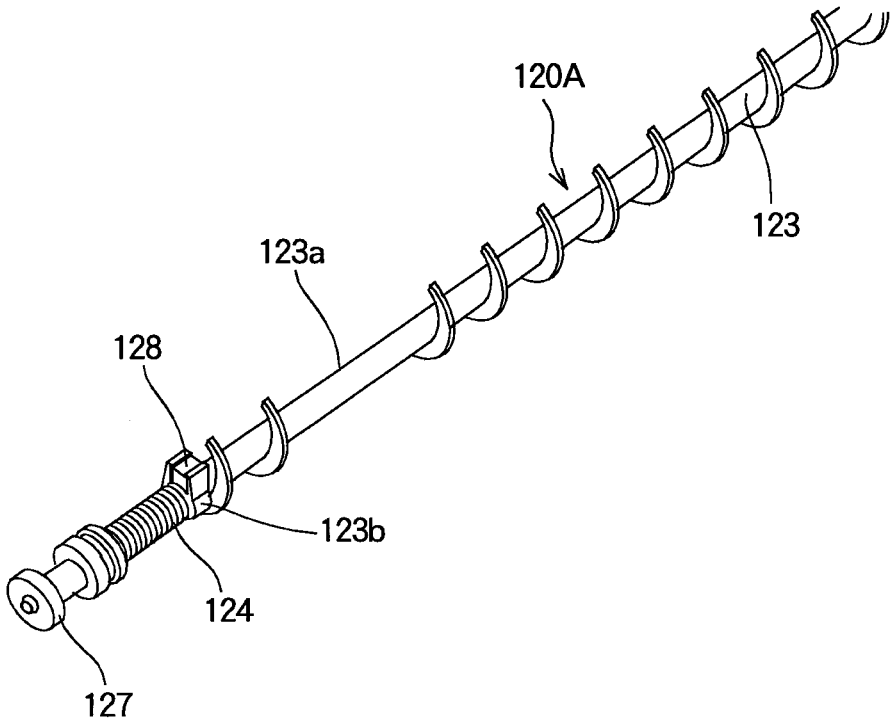
FIG. 11 is a perspective view showing a drive-side spiral according to the fourth embodiment of the present invention.
Figure 12:
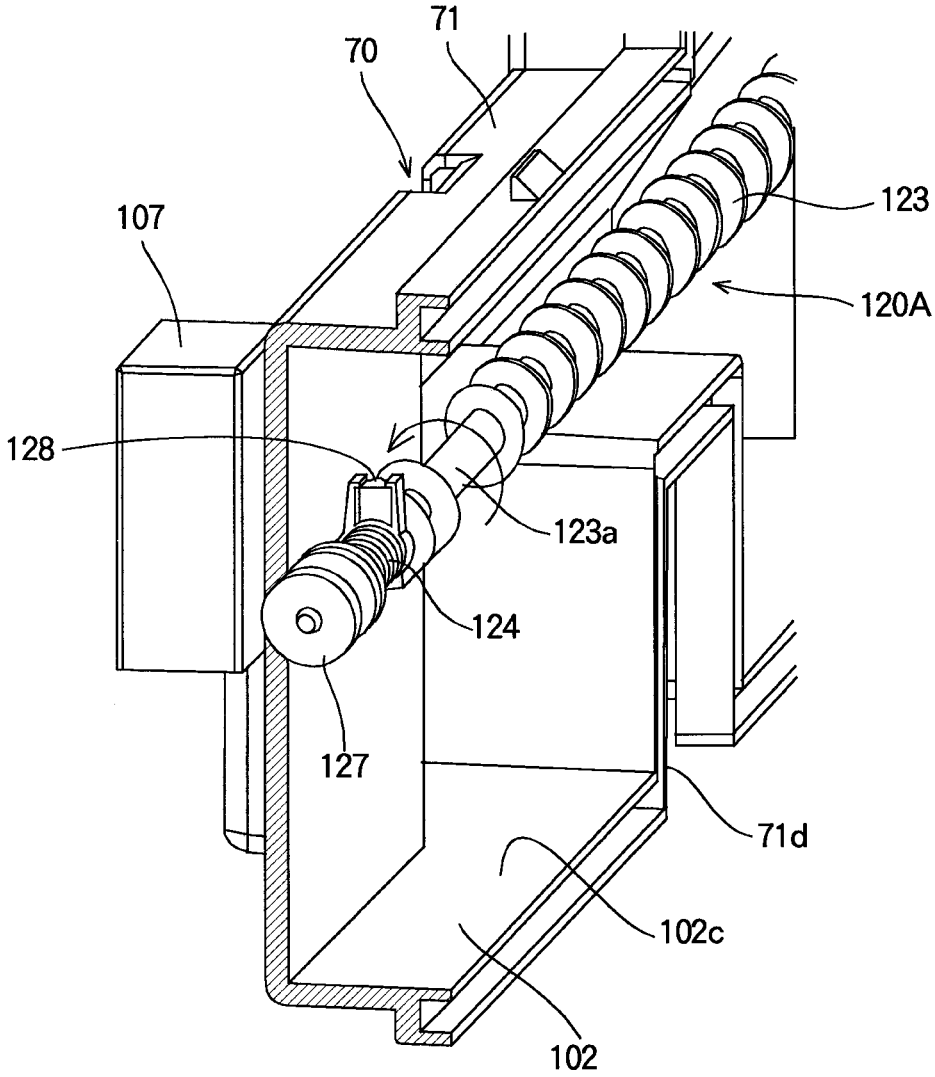
FIG. 12 is a partial perspective view showing a driven-side spiral and its surroundings according to the fourth embodiment of the present invention.

FIG. 11 is a perspective view showing a driven-side spiral 120A of a toner conveying apparatus according to the fourth embodiment of the present invention. FIG. 12 is a perspective view showing the driven-side spiral 120A and its surroundings according to the fourth embodiment of the present invention. In FIGS. 11 and 12, elements that are the same as those of the first and second embodiments (FIGS. 1, 3, 6A and 6B) and those of the third embodiment (FIG. 10) are assigned the same reference numerals.

The driven-side spiral 120A of the fourth embodiment is different from the driven-side spiral 120 of the first, second and third embodiment in the following respects. In the fourth embodiment, the flange 123*b* provided on the downstream end of the driven-side spiral 120A has a holder portion integrally formed therewith. Further, a magnet 128 (as a detector) is fixed to the holder portion of the flange 123*b*. A magnetic flux density detection unit 107 (as a detecting unit) is provided outside the collection container 71 so as to face the magnet 28 fixed to the flange 123*b*. The magnet 128 and the magnetic flux density detecting unit 107 constitute a motion detecting unit that detects a motion (for example, rotation) of the driven-side spiral 120A.

<Operation of Toner Conveying Apparatus>

The toner collection apparatus 70A of the fourth embodiment conveys the waste toner 19 in a similar manner to the toner collection apparatus 70 (70A) described in the first, second or third embodiments. When a load applied to the driven-side spiral 120A is relatively small, the driven-side spiral 120A rotates together with the drive-side spiral 110 (110A) as described in the first through third embodiments. In this state, the magnetic flux density detecting unit 107 periodically reads the magnetic flux of the magnet 128 fixed to the flange 123*b*. That is, the magnetic flux density detecting unit 107 detects that the driven-side spiral 120A is rotating.

When the driven-side spiral 120A stops rotating due to increasing load applied thereto, the magnetic flux density detecting unit 107 does not periodically read the magnetic flux of the magnet 128 fixed to the flange 123*b*. That is, the magnetic flux density detecting unit 107 detects that the driven-side spiral 120A stops rotating.

In the fourth embodiment, the stopping of the driven-side spiral 120A can be detected using the magnet 128, and therefore it becomes possible to detect the amount of the waste toner 19 in the collection container 71 accordingly. Further, as the driven-side spiral 120A stops rotation, a driving force for rotating the conveying spiral 80 decreases, and therefore current value flowing through the driving unit (such as the driving motor) can be reduced.

Advantages to Fourth Embodiment

According to the fourth embodiment, it becomes possible to detect the stopping of the driven-side spiral 120A using the detector such as the magnet 128 provided on the driven-side spiral 120A. Further, by detecting the stopping of the driven-side spiral 120A, it becomes possible to recognize (and inform a user) that time for replacement of the collection container 71 will soon arrive, before the waste toner storage amount detecting portion 90 detects that the waste toner 19 in the toner storage portion 102 reaches the predetermined amount. Further, the driving force for rotating the conveying spiral 80 decreases, and therefore current value flowing through the driving unit can be reduced.

Modifications of Fourth Embodiment (A) In the fourth embodiment, the rotation of the driven-side spiral 120A is detected using the magnet 128 and the magnetic flux density detecting unit 107. However, it is also possible that, for example, the driven-side spiral 120A is configured to push a link lever (not shown) provided on the collection container 71. In this case, when the driven-side spiral 120A rotates, the link lever is periodically pushed by the driven-side spiral 120A, and a motion of the link lever is detected by a sensor (not shown) provided outside the collection container 71.

(B) In the fourth embodiment, the magnet 128 is fixed to the holder portion formed integrally with the flange 123*b*. However, it is also possible to use another element to fix the magnet 128 to the flange 123*b*.

The present invention is not limited to the above described embodiments, and modifications and improvements can be made thereto. For example, in the first through fourth embodiments, descriptions have been made of the conveying spiral 80 (as the developer conveying apparatus) and the collection container 71 (as the developer storage container) of the image forming apparatus 1 that forms an image on the recording medium 20. However, the present invention is also applicable to apparatuses configured to convey a powder, other than the image forming apparatus.

Further, in the first through fourth embodiments, descriptions have been made of the toner collection apparatus 70 for storing waste toner 19. However, the present invention is also applicable to a toner supplying apparatus that stores a new (unused) toner.

In the first through fourth embodiment, the first conveying portion of the drive-side spiral 110 (i.e., the first conveying member) and the second conveying portion of the driven-side spiral 120 (i.e., the second conveying member) are in the form of blades. However, the first conveying portion of the drive-side spiral 110 and the second conveying portion of the driven-side spiral 120 can be in the form of, for example, coils.

While the preferred embodiments of the present invention have been illustrated in detail, it should be apparent that modifications and improvements may be made to the invention without departing from the spirit and scope of the invention as described in the following claims.

What is claimed is:

1. A developer conveying apparatus comprising:

a main body in which a developer is conveyed;

a conveying unit that conveys the developer in the main body; and a developer storage amount detecting portion provided in the main body configured to detect a storage amount of the developer, the developer storage amount detecting portion being located above the conveying unit, wherein the conveying unit comprises:

a first conveying member including a first rotation body rotatably provided in the main body and a first conveying portion having a spiral shape and provided around the first rotation body, the first conveying member having a contact portion provided on the first rotation body, and a second conveying member including a second rotation shaft rotatably provided in the main body and a second conveying portion having a spiral shape and provided around the second rotation body, the second conveying member contacting the contact portion of the first conveying member, wherein a developer retention portion is formed at a predetermined portion of the second rotation body, and wherein the developer storage amount detecting portion is provided above said contact portion.

2. The developer conveying apparatus according to claim 1, wherein said first conveying portion is a first blade portion, and said second conveying portion is a second blade portion.

3. The developer conveying apparatus according to claim 1, wherein said first rotation body of said first conveying member and said second rotation body of said second conveying member are linearly arranged.

4. The developer conveying apparatus according to claim 1, wherein said developer retention portion is configured as a portion of said second conveying member where a part of said second conveying portion is removed.

5. The developer conveying apparatus according to claim 1, wherein said first conveying portion is in the form of a blade having a continuous profile.

6. The developer conveying apparatus according to claim 1, wherein convex portions are formed on an outer circumference of said first conveying portion at constant intervals.

7. The developer conveying apparatus according to claim 6, wherein the convex portions are formed to be higher than the first conveying portion of the spiral shape.

8. The developer conveying apparatus according to claim 1, further comprising a motion detection unit that detects a motion of said second conveying member.

9. The developer conveying apparatus according to claim 8, wherein said motion detection unit detects a rotation of said second conveying member.

10. The developer conveying apparatus according to claim 9, wherein said motion detection unit detects said rotation of said second conveying member by detecting a magnetic flux density generated by means of a magnet.

11. A developer storage container comprising a developer conveying apparatus according to claim 1.

12. An image forming apparatus comprising a developer storage container according to claim 11.

13. The developer conveying apparatus according to claim 1, wherein the first conveying member conveys the developer in a downstream direction, wherein the second conveying member is separate from the first conveying member and conveys the developer in the downstream direction, wherein the second conveying member has a developer retention portion disposed between portions of the second conveying member that convey the developer in the downstream direction.

14. The developer conveying apparatus according to claim 1, wherein the first conveying member conveys the developer in a downstream direction, and the second conveying member conveys the developer in the downstream direction, the second conveying member being connected to the first conveying member, and wherein the developer retention portion is formed in the vicinity of an end portion of the second conveying member in the downstream direction.

15. The developer conveying apparatus according to claim 14, wherein the second conveying member has a tubular shape, and wherein a shaft extending from the first conveying member is inserted through the second conveying member.

16. The developer conveying apparatus according to claim 1, wherein the developer storage amount detecting portion is provided on an upstream side of the conveying unit.

17. The developer conveying apparatus according to claim 1, wherein a magnet is mounted to the second conveying member, the apparatus further comprising a motion detection unit that detects a rotation of the second conveying member by detecting a magnetic flux density generated by the magnet.

18. A developer conveying apparatus comprising:

a main body in which a developer is conveyed;

a first conveying member that conveys the developer in a downstream direction and includes a first rotation body rotatably provided in said main body and a first conveying portion having a spiral shape and provided around said first rotation body; and a second conveying member that conveys the developer in the downstream direction and includes a second rotation body rotatably provided in said main body and a second conveying portion having a spiral shape and provided around said second rotation body, the second conveying member being connected to the first conveying member at a downstream side of the first conveying member along a conveying direction of the developer, the second rotation member contacting the first conveying member, and being rotated by contact with the first conveying member, the second rotation member allowing the first rotation member to rotate even when the second rotation member stops rotation, wherein the second conveying member has a developer retention portion disposed along the second conveying portion between spiral shapes of the second conveying portion that convey the developer in the downstream direction.

19. A developer storage container comprising a developer conveying apparatus according to claim 18.

20. An image forming apparatus comprising a developer storage container according to claim 19.

21. The developer conveying apparatus according to claim 18, wherein convex portions are formed on an outer circumference of the first conveying portion at predetermined intervals, said convex portions protruding in a radial direction of said first rotation body.

22. The developer conveying apparatus according to claim 21, wherein said first conveying portion is a first blade portion, and said second conveying portion is a second blade portion.

23. A developer conveying apparatus comprising:

a main body in which a developer is conveyed;

a conveying unit that conveys the developer in the main body; and a developer storage amount detecting portion provided in the main body configured to detect a storage amount of the developer, the developer storage amount detecting portion being located above the conveying unit, wherein the conveying unit comprises:

a first conveying member including a first rotation body rotatably provided in the main body and a first conveying portion having a spiral shape and provided around the first rotation body, the first conveying member having a contact portion provided on the first rotation body, and a second conveying member including a second rotation body rotatably provided in the main body and a second conveying portion having a spiral shape and provided around the second rotation body, wherein a developer retention portion is formed at a predetermined portion of the second rotation body, and wherein the developer retention portion has a length corresponding to at least three pitches of spiral of the second conveying member.

* * * * *